US005317884A

United States Patent [19]

Lyon

[11] Patent Number: 5,317,884

[45] Date of Patent: Jun. 7, 1994

[54] REFRIGERANT PRE-COOLER

[76] Inventor: Robert J. Lyon, 3611 75th St., Sarasota, Fla. 34243

[21] Appl. No.: 966,425

[22] Filed: Oct. 26, 1992

[51] Int. Cl.[5] ..... F25B 39/04

[52] U.S. Cl. ..... 62/507; 62/304

[58] Field of Search ..... 62/506, 507, 508, 304

[56] References Cited

U.S. PATENT DOCUMENTS 3,908,393 9/1975 Eubank ..... 62/506

4,266,406 5/1981 Ellis ..... 62/507

*Primary Examiner*—Ronald C. Gapssela

[57] ABSTRACT

A refrigerant precooler device, connecting into the Freon line of an existing air conditioning unit, and directing this freon through a finned cooling coil, and having a downdraft fan blowing air downward onto a supply of water in the bottom of the precooler device, and the fan blades being surrounded at a strategic location by a venturi shroud, which tends to disperse some of the air from the fan outward, and over the fins of the cooling coil, thereby causing an accelerated evaporation effect, with the added cooling of the Freon. A controlled supply of water in a reservoir at the bottom of the device is pumped upwards through a tubing device and into a pipe which is located onto the top of the cooling coil, and the pipe has a slot cut lengthwise of its bottom longitudinal dimension, and the pumped water drips out of the slot in the pipe, and drains downward over the fins of the cooling coil.

As stated, the air from the fan tends to cool the supply of water in the reservoir, and, the venturi shroud tends to direct some of the airstream outward, onto, and through the fins of the cooling coil, and, this venturi effect also tends to evaporate some of the water on the fins, which provides even more cooling for the refrigerant.

3 Claims, 3 Drawing Sheets

REFRIGERANT PRE-COOLER

BACKGROUND OF INVENTION

This invention relates to an apparatus and method of precooling the Freon in an air conditioning system, to provide a more efficient system, thereby allowing for less usage of the system to cool an area, with the resulting savings in energy usage.

It has been customary to cool the Freon in air conditioning systems by routing the Freon through a condenser unit, consisting of a sealed coil, through which the Freon is routed, and over which air, water, or other fluids are passed for cooling the Freon. The Freon, thus cooled, is pressurized by a compressor system, until the Freon is converted from a gas to a liquid. This conversion from a gas to a liquid releases heat from the reaction, and this heat is sometimes used to heat an area. In the case of air conditioning, this heat is usually allowed to dissapate in the immediate area. The pressurized liquid Freon is now pumped through an expansion valve, and is subjected to atmospheric pressures, which causes the liquid to re-convert to a gas, and this reaction of converting a liquid Freon to a gas Freon requires heat. The required heat is extracted from the outer surroundings of the expansion valve, and, as a fan blows air over this expansion valve compartment, heat is extracted from the air, thusly cooling the air, and this cooled air is blown outward from the air conditioner into the area to be cooled.

Now, this cooled air having lost some of it's ability to hold water vapor, releases some of its moisture, called the condensation process, and this condensed water, now in liquid form itself, is drained away from the air conditioning system, and is normally wasted. The Freon, now in a gaseous state, is re-routed to the condensing unit, on to the compressor, on to the expansion valve, and a new cycle is repeated.

It has been known for many years in the industry that a lower temperature liquid refrigerant produces a more efficient air conditioning cycle, and, several methods of improving the efficiency of this cycle have been taught in the industry. Engalitcheff, in U.S. Des. Pat. No. 254,149 teaches a water injected cooling tower, that can be used to reduce the temperature of cooling water, or other refrigerants. However, such a device would be too large, and bulky, for use in a normal size domestic, or, commercial air conditioning system. Also, a cooling tower design, taught by Miyamoto in U.S. Des. Pat. No. 284,211 would be somewhat suitable for use with coolants in power plants, or other large installations, but would be impractical for use in typical air conditioning systems.

Bronaugh, in U.S. Des. Pat. No. 296,711, teaches an outdoor condenser cabinet for an air conditioning unit. This unit is designed for use in traditional air conditioning systems, and provides an adequate enclosure for the standard condenser, and condenser cooling fan, however, it does not provide any means of pre-cooling the Freon for the greater efficiency.

Kessler, in U.S. Des. Pat. No. 299,528 teaches an outdoor heat exchanger cabinet which encloses a standard air conditioner condenser, and fan, but, here again, no means of precooling the Freon, before it is pumped through the expansion valve is provided.

Powell, in U.S. Pat. Nos. 4,541,943, and 4,559,154, teaches an improved coolant for vapor recompression type, and absorption type heat pump systems. This coolant is proposed for use in these systems because of its improved heat transfer characteristics, when compared to the traditional coolants used in heat pumps. While these teachings do represent a proposed improvement in the efficiency of air conditioners, the use Freon is still the major refrigerant today.

Continuing, Walker, in U.S. Pat. No. 4,094,935 teaches an evaporative cooling system, in which air from two fans is blown on porous belts which have been immersed in water. This system tends to produce more moisture in the air, thereby sabotaging the entire teaching.

Hinton, in U.S. Pat. No. 4,879,075, teaches another evaporative cooling apparatus, specifically designed for use as its output. In addition, the cooled air, coming from this system is specifically not protected against unpleasant odors, which can be caused by bacteria, and other microorganisms, growing in the evaporation pads, and is clearly not suitable for use in the normal household.

Still another approach is taught by Zimmera, in U.S. Pat. No. 4,903,497, wherein a portion of the coolant itself is used to provide cooling of the comporessor motor. This method is to be somewhat compared to a perpetual motion device, in that the motor give off heat, when operated, and this heat would be absorbed by the refrigerant system, thereby sabotaging the air conditioning philosophy itself.

It can be seen that many approaches to this problem have been taught in the prior arts, but, none with really good and practical results.

SUMMARY OF THE INVENTION

Accordingly, it is an object of this invention to provide a new, and improved, method and apparatus for precooling the Freon, or other refrigerant, in air conditioning systems, and thereby increasing the efficiency of the expansion valve system in the air conditioning system used.

It is another object of this invention to provide a new, and improved method and apparatus for more efficiently directing an air flow through the condensing coil of the condenser, using a venturi shroud around the cooling fan.

It is another object of this invention to provide a gravity fed, cool water fall system, the cool water falling downward from the top of the condensing coil of the air conditioning system, using a formed pipe, with a slotted bottom, laying on top of the condensing coil.

It is still another object of this invention to provide a reservoir of fresh water in the bottom of the cooling unit of this invention, and this cool water being pumped upward to the formed, slotted pipe at the top of the condensing coil.

Still another object of this invention is to collect the condensed water from the refrigeration cycle into the reservoir of the invention, and use this condensed water for mixing with the fresh water in the reservoir, thereby providing more efficiency for the system.

Another object of this invention is to provide a method of preventing rust in the unit from electrolysis of the water in the reservoir.

In carrying out this invention in the illustrative embodiment thereof, a container, enclosing a circular, water cooled coil, a downdraft fan, and a reservoir of water is provided. The pressurized liquid Freon from an air conditioning unit is connected to the input line of the water cooled coil, through which the Freon is passed after it returns from the evaporator, and before it is re-cycled to the expansion valve of the air conditioning system. After the liquid Freon passes through the cooling coil, it is connected back into the freon line, and the cooled Freon is routed on to the expansion valve of the existing air conditioning system. The container has a reservoir for holding a supply of fresh water in its bottommost section, and this reservoir has a float control to keep the supply of water at a desired level. A pump, powered from commercial sources of electricity, forces this water from the output of the pump, upward to a circular pipe, and this circular pipe is affixed onto the upper surface of the cooling coil.

Now, the circular pipe has a slot cut into its lower surface, and, as the water from the reservoir is pumped upward into the circular pipe, a continuous flow of cooled water is gravity fed downward, over, and through the fins of the cooling coil, thereby cooling the Freon in the cooling coil.

Now, a separate connection is provided in the container for collecting the water from the condensing coils of the air conditioning system, and filling the reservoir in the bottom of the container, and, an overflow valve is provided in the container for overboarding any excess water from this condensing coil, thereby keeping the water level constant in the reservoir, no matter how much condensate is present from the air conditioner unit.

Also, a supply of pure magnesium is placed in the bottom of the reservoir, and is also grounded to the coil, to control the electrolysis reaction of the water, and the container, thereby extending the life of the coil, and other components in the container.

Now, at the top of the container, a fan is mounted, and the top of the container having ample ventilation to supply the fan with input air. The exhaust from the fan is fed through a shroud, and this shroud having a formed opening to provide a venturi effect on the stream of air from the fan. As the air, at a lower pressure, is exhausted downward, from the venturi shroud, it immediately is subjected to an increase in pressure, and this increase in pressure, with the accompanying increase in volume, causes the air stream to be dissapated outwardly through the fins of the surrounding cooling coik, thereby insuring a complete circulation of the air through the fins of the cooling coil. Also, the remaining exhaust air from the fan is forced downward, onto the surface of the water in the reservoir, thereby tending to cool this reservoir water, before it is forced upward by the pump, to the slotted pipe at the top of the cooling coil.

Conveniently, the user may connect this invention into the freon line from their air conditioning unit, allow the invention to pre-cool the Freon before it is exposed to the expansion valve of their air conditioner, thereby increasing the efficiency of the air conditioner, with the resulting savings in the operation of the system.

BRIEF DESCRIPTION OF THE DRAWINGS

This invention, together with other objects, features, aspects and advantages thereof, will be more clearly understood from the following description, considered in conjunction with the accompanying drawings.

Three sheets of drawings are furnished, sheet 1 has FIG. 1, sheet 2 has FIGS. 2, and 3, sheet 3 has FIGS. 4 and 5.

DESCRIPTION OF THE PREFERRED EMBODIMENTS

Figure 1:
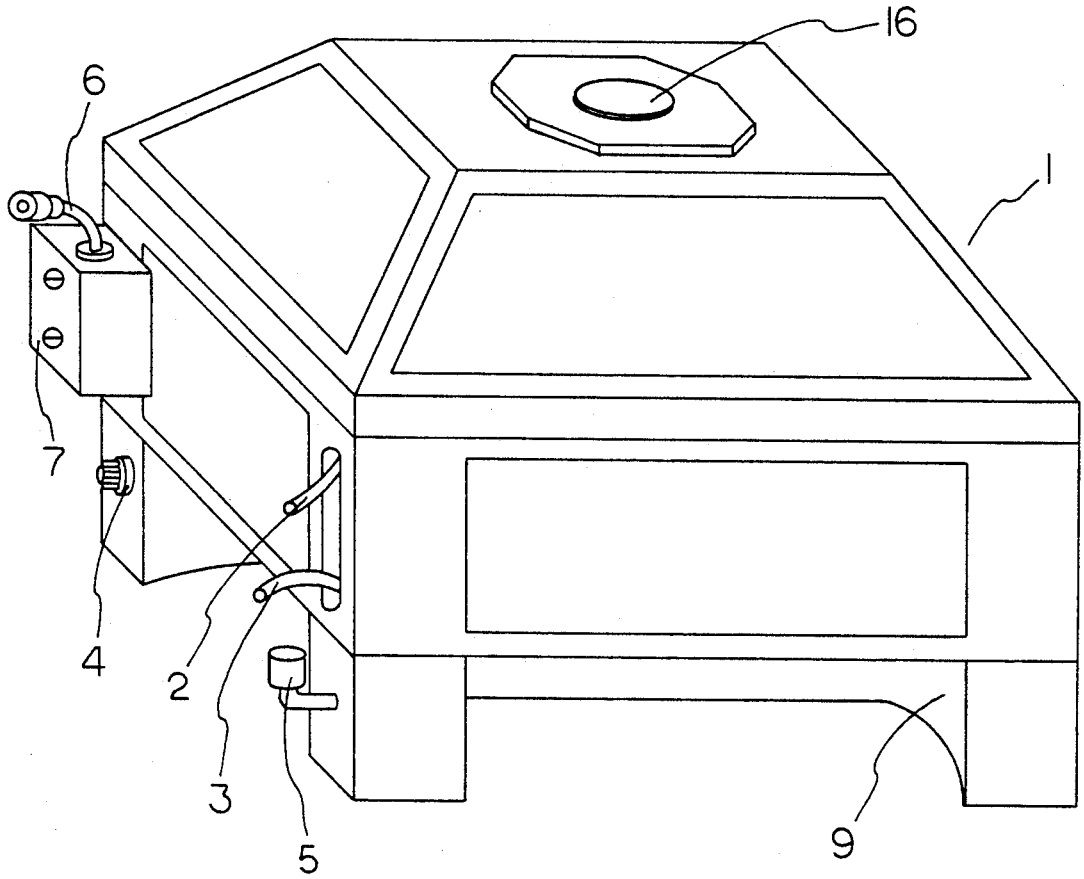
FIG. 1 is an isometric view of the invention, showing all connections, covers and panels.

Referring now to FIG. 1, a freon precooler, referred to generally by the reference numeral 1 is made of suitable materials. Still referring to FIG. 1, we see on the rear panel of precooler 1 a Freon inlet line 2, a Freon outlet line 3, a fresh water supply connector 4, an adjustable condensate inlet 5, an electrical conduit 6, and an electrical junction box 7.

Figure 3:
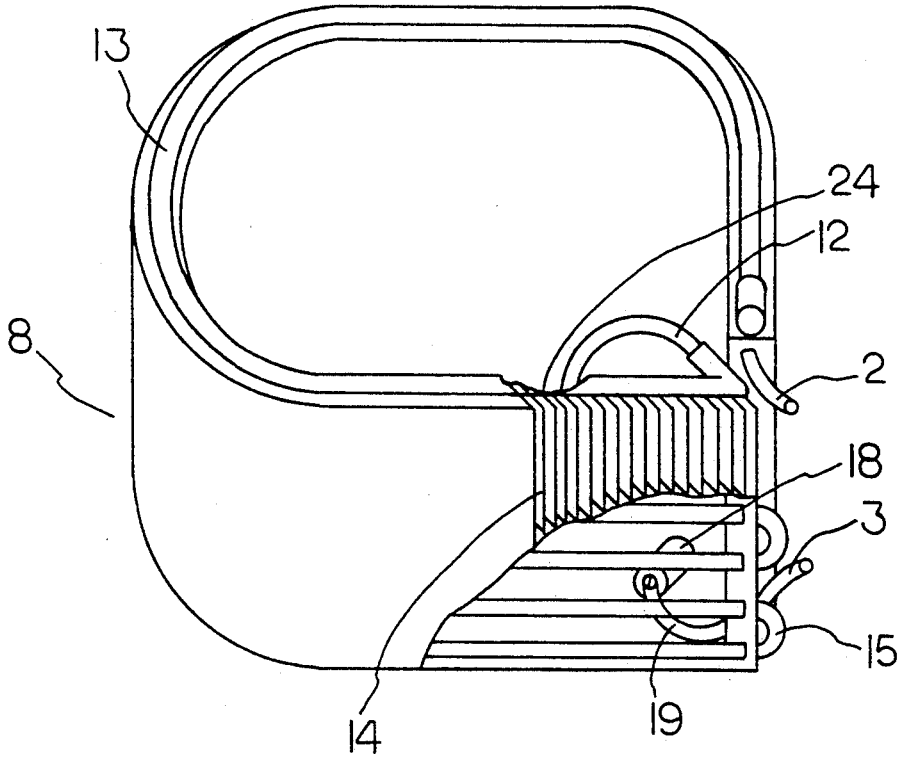
FIG. 3 is an isometric view of the top of the coil, showing the slotted water pipe affixed onto its top, and showing the magnesium anode assembly.

Now, referring to FIG. 3, warm Freon from the compressor portion of the existing air conditioner is routed into precooler 1 by means of Freon inlet line 2, is passed through coil 8, and flows out of precooler 1 through Freon outlet line 3.

Referring again to FIG. 1, cooling water is supplied to precooler 1 from a water main, via water supply connector 4. This water collects in a reservoir 9, which is the bottom portion of precooler 1, and this water level is maintained constant by float valve 10, more easily seen in FIG. 3. Additional water can be dripped into reservoir 9 through adjustable condensate inlet 5, inlet 5 being turned from an upward vertical position to a horizontal position, allowing excess condensate to drain from reservoir 9, during excessive condensation periods of operation.

Figure 4:
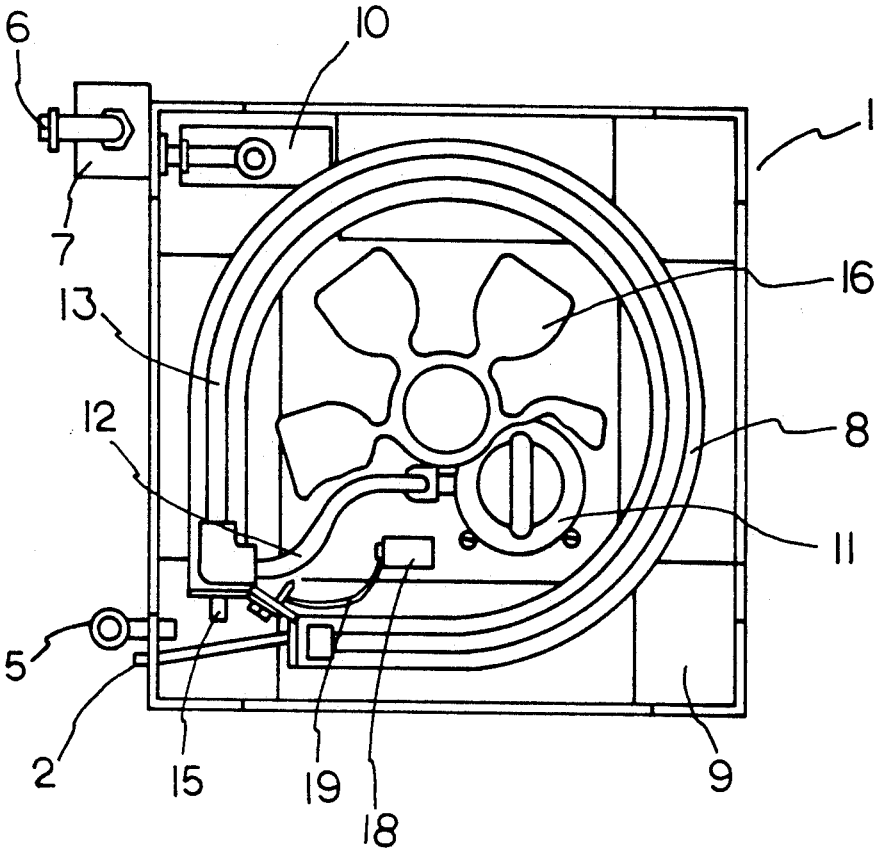
FIG. 4 is a top view of the precooler, showing the water inlet, the fan, and the sump pump, as well as the anode.

Referring now to FIG. 4, we see a top view of precooler 1, showing a sump pump 11, and sump pump 11 having a flexible output tube 12, and sump pump 11 pumping water from reservoir 9 upwards through flexible tube 12 to slotted pipe 13, slotted pipe 13 being affixed onto the upper surface of cooling coil 8. As the water from reservoir 9 flows through slotted pipe 13, water seeps through the slot 24 in pipe 13, and flows downward through the fins 14 of coil 8, thusly tending to provide cooling to the freon flowing in Freon tube 15. Freon tube 15 being interwoven throughout cooling coil 8, as seen in FIGS. 2, and 3, and tube 15 having fins 14 affixed along its entire length, and fins 14 providing a heat transfer to open air, for the freon being cooled.

Figure 2:
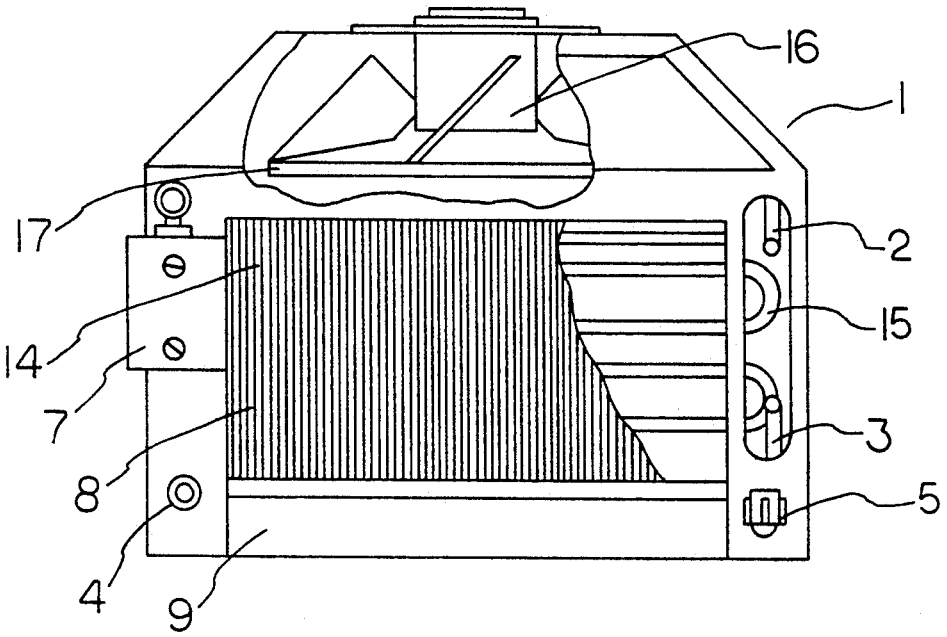
FIG. 2 is an isometric view of the rear of the precooler, showing the coil, the connections, and the downdraft fan.

Referring now to FIG. 2, this cooling effect of the water flowing over fins 14 of coil 8, is enhanced by the air flow created by operation of a downdraft top fan 16. The efficiency of this cooling air being exhausted from fan 16 is increased by venturi collar 17, venturi collar 17 surrounding the blades of fan 16, thereby causing the downward air flow to be restricted by the lower pressure developed in venturi collar 17, and then, this air being expanded outward into fins 14 of coil 8, when the air flow exits the venturi collar 17, and, gaining pressure, and volume, as it leaves venturi collar 17, being dispursed outward through the fins 14, and also downward onto the surface of the water in reservoir 9.

The air dispursed into the cooling coil 8, due to the action of venturi collar 17, causes accelerated evaporation of the water in the fins 14 of coil 8, thereby providing additional cooling of the Freon. The remaining water dripping from the cooling coil 8 returns to reservoir 9, and completes the cycle.

Figure 5:
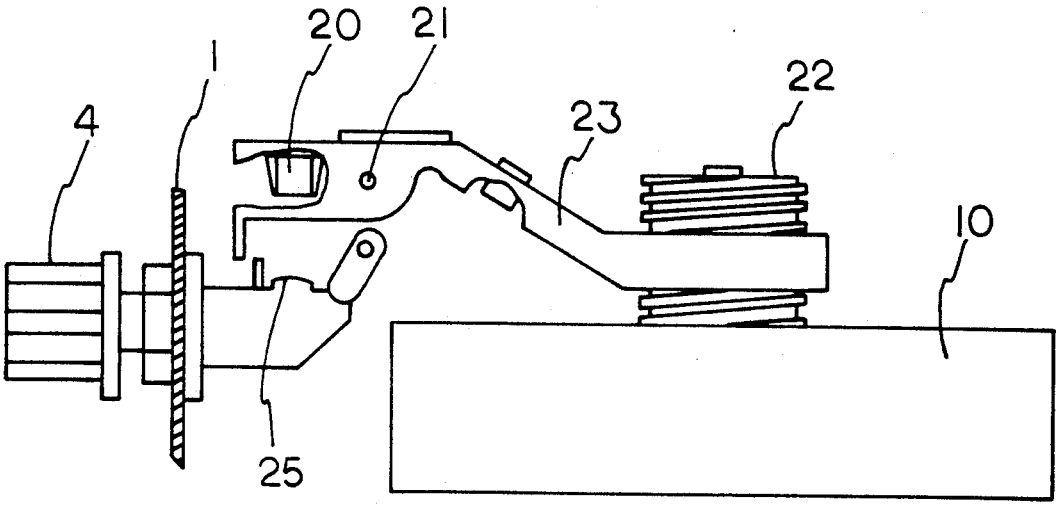
FIG. 5 is a side view of the water inlet, showing the float, and its adjusting mechanism.

Now, referring to FIG. 5, we see a water supply connected to precooler 1, using water connector 4. Water flows into precooler 1 and into reservoir 9 through input 25, thereby filling reservoir 9. Now, float valve 10, floating on top of the water in reservoir 9, rises upwards as the water fills reservoir 9, and, acting on hinge 21, pushes stopper 20 downward, and into input 25, thereby closing inlet 25, and shutting off the water to reservoir 9. Float 10, having actuating arm 23, and actuating arm 23 being threaded onto adjuster 22, and adjuster 22 being affixed onto the top of float 10, provides adjusting means for the water level in reservoir 9. Also, for further water level adjustment in reservoir 9, and referring back to FIG. 2, condensate inlet 5 can be turned from upward vertical position, clockwise to a more horizontal position, to drain off excess condensate, and maintain the desired water level in reservoir 9.

Now, and referring to FIG. 3, a piece of magnesium is placed on the bottom of reservoir 9, and is used as a magnesium anode 18, to direct any electrolysis away from the metal parts of precooler 1, and the reaction of this magnesium anode 18 is further induced by ground wire 19, which is connected to coil 8, and, as magnesium is higher on the electromotive series than is the metal in the fins 14, of coil 8, the magnesium anode 18 will disintegrate first, thereby protecting coil 8 from damage due to electrolysis.

Accordingly, a very unique, attractive, convenient method and apparatus are provided for precooling the Freon in an air conditioning system, thus increasing the efficiency of the system, and providing a lower cost of operation of the system.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A refrigerant precooler for precooling the refrigerant in an air conditioning system, comprising:

a cabinet for housing all of the components of said precooler, said components being:

a finned coil, said finned coil being of a substantially circular design to fit the inside dimensions of said cabinet, said coil having input, and output affixing means for connecting into the existing freon supply of an existing air conditioning system, a reservoir compartment in the bottom of said cabinet, said reservoir having controlled filling means from a constant supply of water, said controlling means being a float valve assembly, and said float valve assembly turning on, and turning off the water supply to said reservoir, said reservoir also having means for accepting, and controlling the amount, of condensate from said existing air conditioning system, said controlling means being a rotatable drain nozzle, said drain nozzle being affixed onto said reservoir at the desired level of water in said reservoir, a partially submerged sump pump, located on the bottom of said reservoir, said sump pump providing pumping means to pump said water from the bottom of said reservoir upwards through a tube apparatus and into a pipe, said pipe affixed onto the top of said cooling coil, and said pipe having a drain slot cut longitudinally along its bottom, and said bottom being mated to the top of said cooling coil, and said drain slot providing dripping means for dispersing water onto said top of said cooling coil, said water draining downward, over said fins of said cooling coil, thereby providing cooling means for said Freon in said cooling coil, a downdraft fan, affixed at the top of said refrigerant precooler, said fan providing air cooling means to said water in said reservoir, a venturi shroud, located at a position to surround the blades of said fan, and to provide a venturi effect to the air stream exhaust of said fan, thereby providing outward directed air into said fins of said cooling coil.

2. A refrigerant precooler of claim 1 having a supply of magnesium located on the bottom of said reservoir, and said magnesium having affixing means to said cooling coil, thereby providing protection from electrolysis reactions to said coil, and other components of said refrigerant precooler.

3. A venturi shroud of claim 1 having outward air dispersing means to said cooling coil of claim 1, thereby providing evaporation means for said dripping water from said slotted pipe of claim 1, thereby providing additional cooling from said evaporation process for said Freon of claim 1.

* * * * *